United States Patent [19]

Dallaire et al.

[11] Patent Number: 4,579,377

[45] Date of Patent: Apr. 1, 1986

[54] LOCKING DEVICE TO ARREST A DISPLACEABLE MEMBER SUCH AS A DOOR OR WINDOW

[75] Inventors: Michel Dallaire, Montreal; Robert LaRoche, Ste. Julie, both of Canada

[73] Assignee: Vindas Inc., Quebec, Canada

[21] Appl. No.: 482,194

[22] Filed: Apr. 5, 1983

[51] Int. Cl.[4] ..... E05C 17/54

[52] U.S. Cl. ..... 292/343; 156/293

[58] Field of Search ..... 292/343; 156/71, 291, 156/293

[56] References Cited

U.S. PATENT DOCUMENTS

| | | | |
|---|---|---|---|
| 372,655 | 11/1887 | Cashin | 292/343 |
| 1,021,405 | 3/1912 | Gideon | 52/506 |
| 1,351,453 | 8/1920 | Wells, Jr. | 292/343 |
| 1,500,562 | 7/1924 | Hopf | 292/343 |
| 1,786,781 | 12/1930 | Shoemaker | 156/291 X |
| 2,102,937 | 12/1937 | Bauer | 156/291 X |
| 3,833,963 | 9/1974 | Waters | 292/343 X |
| 4,208,841 | 6/1980 | Starks | 292/343 X |

FOREIGN PATENT DOCUMENTS

| | | | |
|---|---|---|---|
| 9831 | of 1891 | United Kingdom | 292/343 |
| 956671 | 4/1964 | United Kingdom | 292/343 |

*Primary Examiner*—Kenneth J. Dorner
*Assistant Examiner*—Lloyd A. Gall
*Attorney, Agent, or Firm*—Oblon, Fisher, Spivak, McClelland & Maier

[57] ABSTRACT

A locking device to arrest a displaceable member such as a door or window. The device comprises a stop member having a bottom wall and an angulated abutment wall extending thereabove. The abutment wall is inclined rearwardly from an end of the bottom wall. A fastener member is provided and has an adhesive to secure it to a substantially flat surface. A sliding connector is formed between the stop member and fastener member to removably interconnect them together.

10 Claims, 15 Drawing Figures

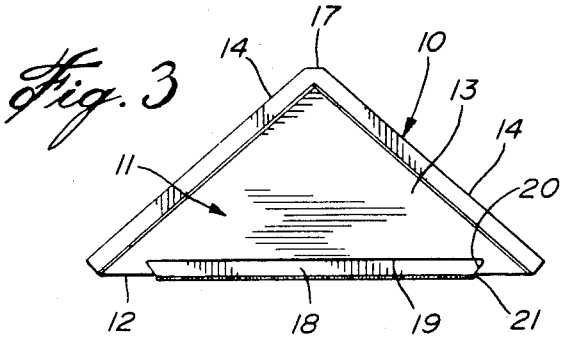
Fig. 3
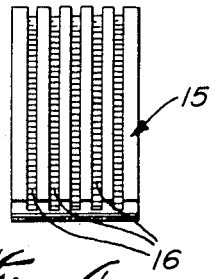
Fig. 4
Fig. 5
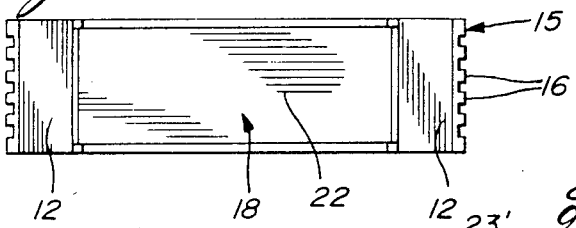
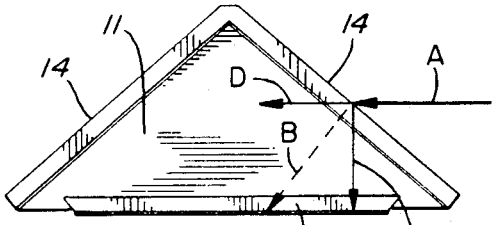
Fig. 6
Fig. 7A
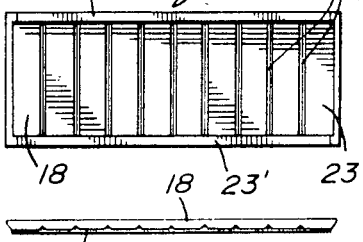
Fig. 7B
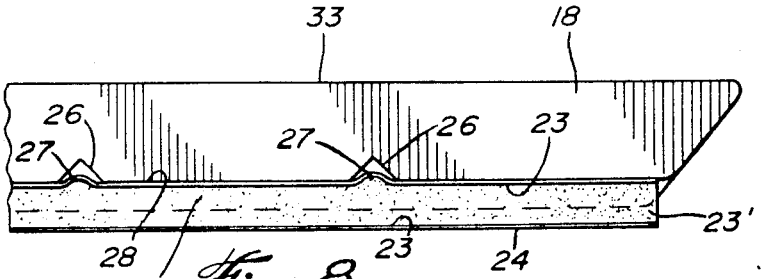
Fig. 8

LOCKING DEVICE TO ARREST A DISPLACEABLE MEMBER SUCH AS A DOOR OR WINDOW

BACKGROUND OF INVENTION (a) Field of the Invention

The present invention relates to a locking device and wherein a stop member is removably secured to a fastener member which is adhesively secured to a flat surface whereby when the stop member is secured to the fastener a displaceable member such as a door or a window is arrested from displacement.

(b) Description of Prior Art

A multitude of locking devices have heretofore been provided whereby to arrest a displaceable member such as a door or a window. However, such devices require tools whereby to install them or else are bulky and difficult to install. They also cause damage to window or door frames when installing or in use. Still further, such locking devices do not have the flexibility of permitting a window pane or a door to be opened a specific distance and then arrested, which distance is determined at will by the user and which is advantageous to permit the entry of fresh air into an enclosure. Still further, prior art locking devices are not versatile and are usually constructed for a single specific use.

SUMMARY OF INVENTION

It is a feature of the present invention to provide a locking device to arrest a displaceable member such as a door or a window and which substantially overcomes all of the above disadvantages of the prior art.

Accordingly, the locking device of the present invention does not require any tools for installation, does not cause any damage to door frames or window frames, is easy to install, and is versatile in its use.

According to a further broad aspect of the present invention there is provided a locking device to arrest a displaceable member such as a door or a window. The device comprises a stop member having a bottom and an angulated abutment wall extending thereabove. The abutment wall is inclined rearwardly from an end of the bottom wall. A fastener member having an adhesive securement means is provided to attach same to a substantially flat surface. Attachment means is provided to removably interconnect the stop member to the fastener member.

BRIEF DESCRIPTION OF DRAWINGS

A preferred embodiment of the present invention will now be described with reference to the example thereof as illustrated in the accompanying drawings, in which:

FIG. 3 is a side view of the stop member;

FIG. 4 is an end view of the stop member showing the abutment wall;

FIG. 5 is a bottom view of FIG. 3;

FIG. 6 is another side view of the stop member;

FIG. 7A is a bottom view of the fastener member without the adhesive strip;

FIG. 7B is a side view of FIG. 7A showing the adhesive strip secured to the bottom face of the fastener member;

FIG. 8 is an exploded view of a section of FIG. 7B;

DESCRIPTION OF PREFERRED EMBODIMENTS

Figure 1:
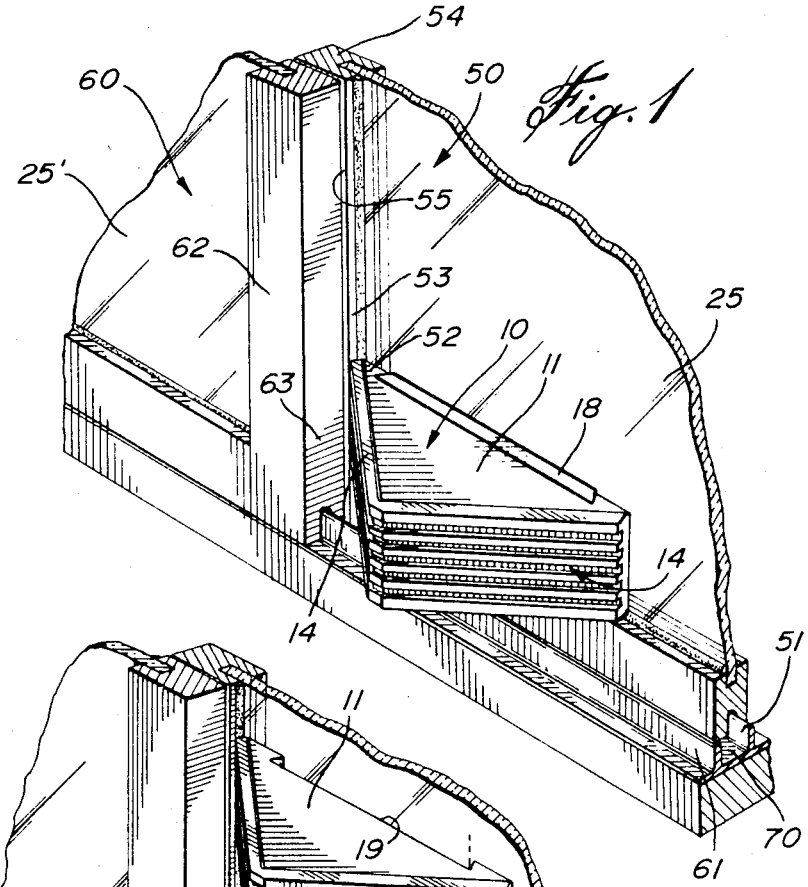
FIGS. 1 and 2 are perspective views showing the locking device of the present invention as secured to a window pane.

A preferred embodiment will now be described with reference to FIGS. 1 to 5 where there is generally shown at 10 the locking device of the present invention. The locking device comprises a stop member 11 which is a triangular block having a flat rectangular bottom wall 12, flat parallel side walls 13 and two sloping top walls 14. Each of the top walls constitutes an abutment wall. As shown in FIGS. 3 to 5, the abutment wall is a flat surface which is covered with a shock-absorbing material 15, such as rubber or other suitable soft material, and has a plurality of spaced apart ribs 16 extending parallel to one another and longitudinally of the abutment wall. Both abutment walls are inclined rearwardly from an end of the bottom wall 12 to an apex 17.

A fastener member 18 is slidingly received within a slot 19 formed in the bottom wall 12 and extending thereacross from the opposed side walls 13. The slot 19 has a flat bottom wall and end walls 20 having a dovetail shape whereby to receive the wedge shaped ends 21 of the fastener member in close frictional fit therein. Of course, it is conceived that the end walls of the slot 19, instead of being dovetailed, could have a rectangular recess therein to receive a rectangular rib from the end wall of the fastener member to achieve the same purpose. Furthermore, instead of the slot 19 being provided in the bottom wall of the stop member 11, it could be provided in the top wall of the fastener member and a protrusion could be provided in the bottom wall 12 of the stop member to be received in the slot of the fastener to achieve the same result. This type of an arrangement would be obvious to a person skilled in the art.

Figure 2:
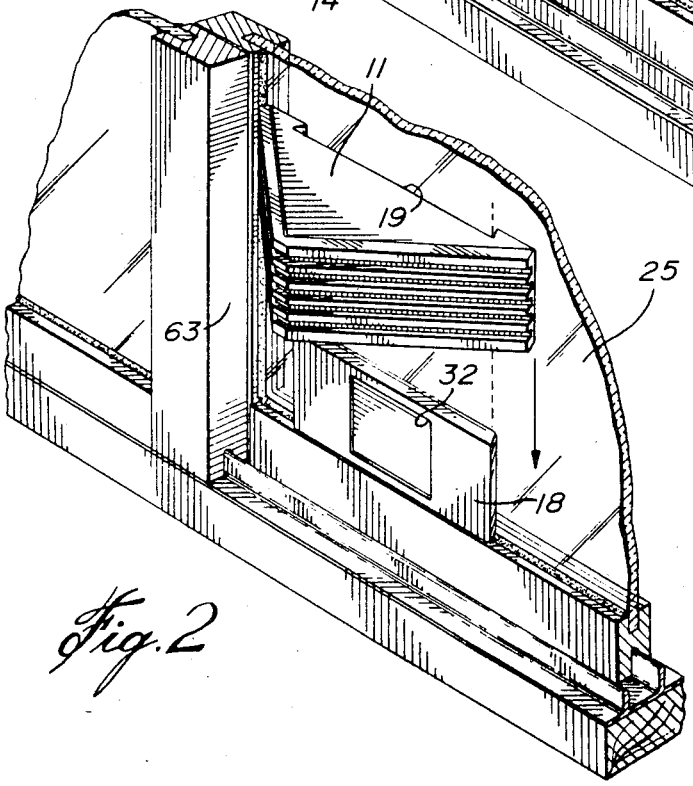

Referring now to FIGS. 5, 7A, 7B and 8, it can be seen that the fastener member is provided with an adhesive securement means in its lower surface 23. The adhesive securement means herein shown is an adhesive tape 22 having an adhesive on both faces thereof. The lower face 23 of the adhesive tape is provided with the usual peel-off wax sheet 24 which protects the adhesive surface until it is time to secure the fastener member 18 to a substantially flat surface, such as a glass pane 25, as shown in FIGS. 1 and 2.

It is pointed out that instead of an adhesive tape 22, an adhesive layer could be simply sprayed on the bottom surface 23 of the fastener member and the transverse slots 26 may be eliminated.

As clearly shown in FIGS. 7A and 8, a plurality of transverse slots 26 are disposed transversely across the bottom surface 25 of the fastener member between side flanges 23' which act as guides to position the adhesive tape 22 on the bottom surface 23. The slots 26 also extend parallel to one another. The purpose of the slots is to receive a beaded portion 27 of the top surface 28 of the adhesive tape 22 when a pressure is applied between the bottom surface of the adhesive layer as a result of a force applied (as shown at A in FIG. 6) to one of the sloping walls 14 whereby to enhance the gripping action of the bottom wall 23 of the fastener member to the top surface 28 of the tape and further enhance the adhesiveness of the bottom wall 24 of the tape on a flat surface to which it has been attached. Thus, when a pressure is applied in the direction of arrow A the transferred force as illustrated by vector B will decompose into vector C and D. However, due to the angle of the abutment wall 14 the transferred force along vector C will always be greater than the force along vector D. The direction of the force along vector C causes the adhesion of the fastener member to become stronger and resist displacement of the stop member 11.

Figure 9:
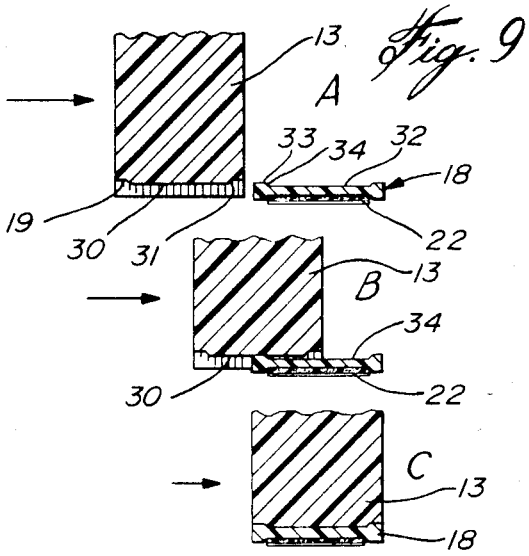
FIG. 9 illustrates functional section views showing the position retention means between the stop member and the fastener member.

Referring now to FIG. 9 there is shown an example of the position retention means provided between the stop member 11 and the fastener member 18. The position retention means is herein shown as provided by a slightly elevated formation 30 provided in the slot bottom wall 19. This formation has inwardly angulated side walls 31 to facilitate the passage of a fastener member thereover. A correspondingly shaped cavity 32 is provided in the flat top wall 33 of the fastener member 18 and is also provided with slightly outwardly shaped side walls 34 to facilitate the removal of the fastener member from engagement with the elevated formation 30. Thus, it can be seen from the illustrations of FIG. 9 that as the fastener member 18 is slid into the slot 19 the stop member is engaged in position on the fastener member and requires a slight force in the direction of the slot for disengagement. This sliding attachment means prevents the stop member 11 from disengaging by gravity when it is mounted in a position on a window pane such as illustrated at 40 in FIG. 10A, as without the sliding attachment means the stop member would fall downwardly by gravity.

The use of the locking device will now be described with reference to FIGS. 1, 2, and 10A to 10D. As shown in FIGS. 1 and 2 there is provided two window panes 50 and 60 each comprised of a glass pane 25 and 25'. One of these panes or both of them are slidable on a respective track 51 and 61 respectively provided by a channel member 70. In order to arrest any of these two panes from sliding on their respective tracks, all that is necessary to do is to slide the fastener member into the stop member and remove the peel-off protective surface 24 from the adhesive layer on the bottom surface 23 of the fastener member. The locking device is then simply positioned against the window pane 25 with an end 52 of the locking device being positioned against the inner edge 53 of the frame 54 of the pane 25. The thickness of the fastener member 18 is thinner than the distance between the outer face 55 of the frame 54 and the surface of the glass 25. Accordingly, when the stop member 11 is slid off the fastener member 18 the frame 62 of the window pane 60 will be able to slide on its track 61 across the window pane 25 or vice versa. With the stop member in position as shown in FIG. 1 none of the frames can be slid on their tracks 61 as the end edge 63 of the window frame 62 will strike against the angulated abutment wall 14 and apply a force to the stop member in the direction of arrow A, as shown in FIG. 6. The shock-absorbing material 15 also protects the side edge 62 of the window frame from being damaged.

Figure 10E:
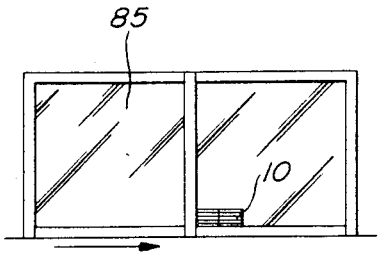
FIGS. 10A through 10E are schematic views showing the use of the locking device as applied to sliding doors, sliding windows, and hinge doors.
Figure 10A:
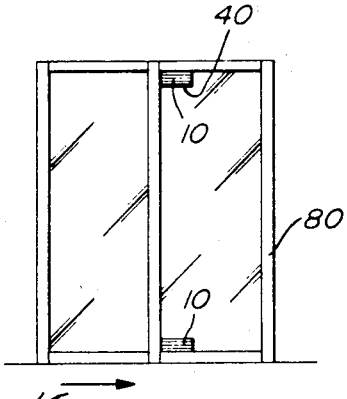
Figure 10B:
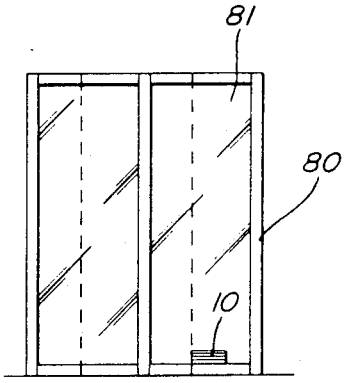
Figure 10C:
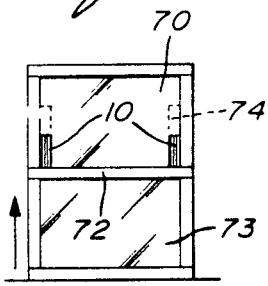

Referring now to FIG. 10C, there is shown the locking device 10 secure to a pane 70 in a window structure wherein the windows are slidable vertically into the frame 71. Thus, the top frame 72 of the lower pane 73 is arrested from moving up by locating the stop member immediately adjacent the top frame 72. Alternatively, the stop member could be positioned at location 74 shown in phantom line whereby to permit the lower pane 73 to be raised a limited distance whereby to admit fresh air into an enclosure but leaving an opening sufficiently small to prevent a person from entering into the enclosure. Similarly, as shown in FIGS. 10A, 10B and 10E, the locking device 10 may be secured to a pane of a sliding door 80 or sliding window 85. Partial opening is also provided as shown in FIG. 10B by locating the locking device a predetermined distance on the glass pane 81 of the sliding door 80 whereby to provide ventilation of the enclosure. It is pointed out that the locking device may be mounted at any operative convenient location on the panes.

Figure 10D:
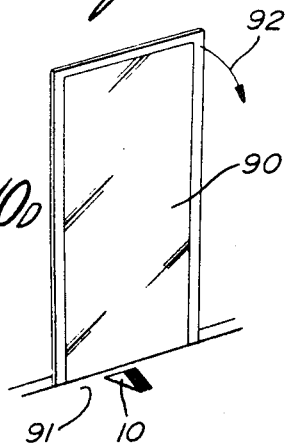

FIG. 10D shows another application wherein the locking device is secured to a floor surface 91 adjacent a hinge door 90 whereby when the stop member is secured to the fastener member the door will be arrested from opening in the direction of arrow 92. The fastener member is sufficiently thin to permit the door to be swung thereover when the stop member 10 is removed from securement thereto.

It is conceived that other applications of the locking device are possible and that obvious modifications could be made to the locking device without departing from the scope of the present invention which is defined by the appended claims. For example, the shock absorbing surface on the abutment walls may be provided with a uniform shock absorbing material rather than having ribs.

We claim:

1. A locking device to arrest a displaceable member such as a glass door or window, said device comprising a stop member having a bottom wall and an angulated abutment wall extending thereabove, the abutment wall is inclined rearwardly from an end of said bottom wall, a fastener member having an adhesive layer secured to a flat bottom surface thereof to attach same to a flat glass pane surface, said adhesive layer being an adhesive strip secured to said bottom surface and having a peel-off protective sheet disposed on said adhesive surface to conceal and protect an outer face of said adhesive strip prior to securing said fastener member to said glass pane surface, said flat bottom surface of said fastener member having a plurality of transverse slots whereby to receive a beaded portion of said adhesive layer therein when a pressure is applied between said bottom surface and said adhesive layer to immovably grip said adhesive layer, attachment means to removably interconnect said stop member to said fastener member, said attachment means having position retention means to maintain said stop member and said fastener member in a predetermined position, said fastener member being adhesively securable to an immovable glass pane contained in a frame, and a further pane contained in a movable frame being positioned adjacent said immovable glass pane, said stop member when secured to said fastener member arresting the displacement of said movable frame, said fastener member having a thickness smaller than the distance between said immovable glass pane and an adjacent face of said movable frame whereby said movable frame may be displaced over said immovable frame when said stop member is removed from said fastener member.

2. A locking device as claimed in claim 1 wherein said attachment means comprises a slot in said bottom wall extending to at least one side wall of said stop member and configured to slidingly receive said fastener member in close fit therein.

3. A locking device as claimed in claim 2 wherein said abutment wall is a flat surface having at least part of said surface covered with a shock absorbing material.

4. A locking device as claimed in claim 3 wherein said shock absorbing material is a rubber web having a plurality of spaced apart ribs extending parallel to one another and extending longitudinally of said abutment wall.

5. A locking device as claimed in claim 2 wherein said stop member is a triangular block having a flat rectangular bottom wall, flat parallel side walls and two sloping top walls, each said top wall constituting an abutment wall.

6. A locking device as claimed in claim 5 wherein said slot extends across said bottom wall and said side walls.

7. A locking device as claimed in claim 6 wherein said slot has a flat bottom wall and dovetail side walls, said fastener member being a flat rectangular plate having inwardly inclined straight end edges for close sliding fit in said dovetail side walls when said fastener member is slidingly received in said slot.

8. A locking device as claimed in claim 5 wherein said sloping top walls extend at a predetermined angle with respect to said bottom wall whereby when a force is applied against said sloping walls in a direction parallel to said bottom wall a resulting downward force is transmitted to the bottom wall to enhance said gripping action, said downward force being a dominant transmitted force.

9. A locking device as claimed in claim 2 wherein said slot has a flat bottom wall and side walls, said fastener member being a flat rectangular plate having a flat top and bottom wall, said slot side walls having means to retain said rectangular plate when slid in said slot, said position retention means coacting between said slot bottom wall and a top wall of said rectangular plate to retain said rectangular plate at a predetermined position in said slot.

10. A locking device as claimed in claim 9 wherein said position retention means is provided by a slightly elevated formation in said slot bottom wall and a correspondingly shaped cavity in said fastener member flat top wall whereby when said formation is received in said cavity said stop member is engaged in position on said fastener member and requires a force in the direction of said slot for disengagement.

* * * * *